US011339353B2

(12) United States Patent
Saint Victor

(10) Patent No.: US 11,339,353 B2
(45) Date of Patent: May 24, 2022

(54) ACIDIC HARD SURFACE CLEANER WITH GLYCINE BETAINE ESTER

(71) Applicant: S. C. Johnson & Son, Inc., Racine, WI (US)

(72) Inventor: Marie-Esther Saint Victor, Glencoe, IL (US)

(73) Assignee: S.C. Johnson & Son, Inc., Racine, WI (US)

( * ) Notice: Subject to any disclaimer, the term of this patent is extended or adjusted under 35 U.S.C. 154(b) by 18 days.

(21) Appl. No.: 15/774,477

(22) PCT Filed: Nov. 17, 2016

(86) PCT No.: PCT/US2016/061153

§ 371 (c)(1),
(2) Date: May 8, 2018

(87) PCT Pub. No.: WO2017/099933

PCT Pub. Date: Jun. 15, 2017

(65) Prior Publication Data

US 2019/0203157 A1 Jul. 4, 2019

Related U.S. Application Data

(60) Provisional application No. 62/263,931, filed on Dec. 7, 2015.

(51) Int. Cl.
*C11D 3/20* (2006.01)
*C11D 3/22* (2006.01)
(Continued)

(52) U.S. Cl.
CPC ..... *C11D 3/222* (2013.01); *C11D 1/90* (2013.01); *C11D 1/62* (2013.01); *C11D 3/042* (2013.01);
(Continued)

(58) Field of Classification Search
CPC .. C11D 1/62; C11D 1/90; C11D 3/042; C11D 3/2013; C11D 3/2075; C11D 3/2086; C11D 3/222
(Continued)

(56) References Cited

U.S. PATENT DOCUMENTS 727,948 A 5/1903 Higgins
3,578,499 A 5/1971 Crotty et al.
(Continued)

FOREIGN PATENT DOCUMENTS

AU 81384/91 11/1991
DE 35 27 974 A1 8/1994
(Continued)

OTHER PUBLICATIONS

Abstract of JP A-6-141797 (1985).
(Continued)

*Primary Examiner* — Gregory R Delcotto

(57) ABSTRACT

Cleaning compositions that include (a) a glycine betaine ester, (b) an acidifying agent, (c) polysaccharide thickener, and (d) water, are provided. Commonly, the glycine betaine ester may include one or more compounds of formula (I): $Me_3N^+$—$CH_2$—C(O)—O—R $X^-$ wherein R is an aliphatic group having 8 to 22 carbon atoms and X" represents an inorganic or organic anion. Commonly, the composition has a pH of no more than about 4, a viscosity of no more than about 1,500 cP at a shear rate of 10 at 25° C., and/or a viscosity of at least about 250 cP at a shear rate of 50 at 25° C. (where the viscosities are determined with a Brookfield Cone/Plate viscometer). The cleaning composition may exhibit a unique sheer thinning profile, such that the composition thins less after being sprayed onto a surface and thereby providing a longer contact time than conventional cleaning products.

22 Claims, 1 Drawing Sheet

(51) Int. Cl.

| | |
|---|---|
| ***C11D 3/33*** | (2006.01) |
| ***C11D 3/43*** | (2006.01) |
| ***C11D 1/90*** | (2006.01) |
| *C11D 3/04* | (2006.01) |
| *C11D 1/62* | (2006.01) |

(52) U.S. Cl.
CPC ..... *C11D 3/2013* (2013.01); *C11D 3/2075* (2013.01); *C11D 3/2086* (2013.01)

(58) Field of Classification Search
USPC ..... 510/191, 238, 239, 240, 481, 488, 504, 510/505
See application file for complete search history.

(56) References Cited

U.S. PATENT DOCUMENTS 3,681,141 A 8/1972 Muoio
3,955,986 A 5/1976 Miller
4,020,100 A 4/1977 Evans et al.
4,370,272 A 1/1983 Wechsler et al.
4,578,207 A 3/1986 Holdt et al.
4,690,818 A 9/1987 Puchalski et al.
4,911,858 A 3/1990 Bunczk et al.
4,943,612 A 7/1990 Morita et al.
5,047,167 A 9/1991 Steyn et al.
5,213,792 A 5/1993 Grundmann et al.
5,254,290 A 10/1993 Blandizux et al.
5,336,427 A 8/1994 Bunczk et al.
5,429,755 A 7/1995 Ilardi et al.
5,460,742 A 10/1995 Cavanagh et al.
5,466,395 A 11/1995 Tosaka et al.
5,472,629 A 12/1995 Lysy et al.
5,527,477 A 6/1996 Ilardi et al.
5,562,850 A 10/1996 Woo et al.
5,579,842 A 12/1996 Riley
5,591,376 A 1/1997 Kiewert et al.
5,663,138 A 9/1997 Ilardi et al.
5,686,399 A * 11/1997 Bianchetti ..... C11D 3/042 134/3
5,849,310 A 12/1998 Trinh et al.
5,877,135 A 3/1999 Hahn
5,925,606 A * 7/1999 Stamm ..... C11D 1/72 510/191
5,961,999 A 10/1999 Bimczok et al.
5,981,449 A * 11/1999 Rapisarda ..... C11D 7/34 510/108
5,985,808 A 11/1999 He et al.
6,087,309 A 7/2000 Vinson et al.
6,127,330 A * 10/2000 Bonett ..... C11D 3/0084 252/186.43
6,239,092 B1 * 5/2001 Papasso ..... A01N 33/12 510/238
6,333,299 B1 * 12/2001 Pace ..... C11D 3/042 510/191
6,336,977 B1 1/2002 Menke et al.
6,384,266 B1 5/2002 Farone et al.
6,407,051 B1 6/2002 Smith et al.
6,486,333 B1 11/2002 Murayama et al.
6,491,933 B2 12/2002 Lorenzi et al.
6,551,985 B1 * 4/2003 Bianchetti ..... C11D 1/94 134/25.2
6,586,639 B2 7/2003 Murayama et al.
6,624,126 B1 9/2003 Kasuga et al.
6,667,286 B1 12/2003 Dettinger et al.
6,701,940 B2 3/2004 Tsibouklis et al.
6,914,075 B2 7/2005 Nakano et al.
7,018,970 B2 3/2006 Hsu et al.
7,022,661 B2 4/2006 Behler et al.
7,053,033 B2 5/2006 Scheper
7,229,958 B2 6/2007 Kohle et al.
7,591,272 B2 * 9/2009 Dastbaz ..... C11D 3/042 134/25.2
7,662,225 B2 2/2010 Antoine et al.
7,718,595 B2 5/2010 Murphy et al.
7,829,521 B2 11/2010 Antoine et al.
7,919,447 B1 4/2011 Klinkhammer et al.
7,981,856 B2 7/2011 Antoine et al.
8,143,205 B2 3/2012 Klinkhammer et al.
8,143,206 B2 3/2012 Klinkhammer et al.
8,440,600 B2 5/2013 Klinkhammer et al.
8,444,771 B2 5/2013 Leipold et al.
8,461,093 B2 6/2013 Leipold et al.
8,629,092 B2 1/2014 Woo et al.
8,658,588 B2 2/2014 Wortley et al.
8,835,371 B2 9/2014 Leipold et al.
8,980,813 B2 3/2015 Klinkhammer et al.
8,993,502 B2 3/2015 Klinkhammer et al.
9,068,145 B1 6/2015 Klinkhammer et al.
9,068,152 B2 6/2015 Klinkhammer et al.
9,102,906 B2 8/2015 Leipold et al.
9,169,456 B2 10/2015 Klinkhammer et al.
9,175,248 B2 11/2015 Klinkhammer et al.
9,181,515 B2 11/2015 Klinkhammer et al.
9,187,720 B2 11/2015 Leipold et al.
9,243,214 B1 1/2016 Klinkhammer et al.
9,399,752 B2 7/2016 Klinkhammer et al.
9,410,111 B2 8/2016 Wortley et al.
9,481,854 B2 11/2016 Wortley et al.
9,637,902 B2 5/2017 Burt et al.
9,644,359 B2 5/2017 Burt et al.
9,771,544 B2 9/2017 Klinkhammer et al.
9,909,086 B2 3/2018 Saint Victor et al.
2002/0151446 A1 10/2002 Piterski et al.
2003/0083210 A1 5/2003 Goldberg et al.
2003/0125220 A1 7/2003 Dykstra et al.
2004/0221870 A1 11/2004 Canoiranzo et al.
2005/0090422 A1 4/2005 Lukenbach et al.
2005/0129626 A1 6/2005 Koivisto et al.
2005/0215447 A1 * 9/2005 Evers ..... C11D 1/72 510/238
2005/0215448 A1 * 9/2005 Evers ..... C11D 3/042 510/238
2006/0079429 A1 * 4/2006 Blagg ..... C11D 3/3956 510/379
2006/0111262 A1 5/2006 Conzelmann et al.
2006/0204526 A1 9/2006 Lathrop et al.
2007/0105737 A1 * 5/2007 Dastbaz ..... C11D 3/042 510/238
2009/0053323 A1 * 2/2009 Tichy ..... A01N 59/00 424/618
2009/0215909 A1 8/2009 Wortley et al.
2009/0298737 A1 * 12/2009 Dastbaz ..... C11D 3/042 510/238
2009/0325839 A1 12/2009 Wortley et al.
2011/0166105 A1 7/2011 Farng et al.
2012/0108490 A1 5/2012 Wortley et al.
2012/0213725 A1 * 8/2012 Galleguillos ..... A61K 8/463 424/70.16
2012/0232170 A1 9/2012 Klinkhammer et al.
2012/0252712 A1 10/2012 Albers et al.
2013/0291764 A1 11/2013 Mehalebi et al.
2013/0338227 A1 12/2013 Saint Victor et al.
2014/0037569 A1 2/2014 Leipold et al.
2014/0248220 A1 9/2014 Abram et al.
2014/0298577 A1 10/2014 Burt et al.
2014/0356311 A1 12/2014 Leipold et al.
2016/0340621 A1 11/2016 Wortley et al.
2016/0355765 A1 12/2016 Klinkhammer et al.
2017/0009189 A1 1/2017 Rees et al.
2017/0015958 A1 1/2017 Rodrigues
2017/0015959 A1 1/2017 Rodrigues
2017/0034793 A1 2/2017 Uchino et al.
2017/0058240 A1 3/2017 Wortley et al.
2017/0362540 A1 12/2017 Klinkhammer et al.

FOREIGN PATENT DOCUMENTS

EP 0 192 145 A2 8/1986
EP 0 631 788 1/1995
EP 0 844 303 A2 5/1998
EP 1 978 080 A1 10/2008

(56) References Cited

FOREIGN PATENT DOCUMENTS

| | | | |
|---|---|---|---|
| GB | 2 280 906 | | 2/1995 |
| GB | 2 288 186 | | 10/1995 |
| WO | WO-96/38528 | | 12/1996 |
| WO | WO-97/05232 | | 2/1997 |
| WO | WO-97/08284 | | 3/1997 |
| WO | WO-97/40133 | | 10/1997 |
| WO | WO-02/26925 | A1 | 4/2002 |
| WO | WO-03/066797 | A1 | 8/2003 |
| WO | WO-2005/121294 | | 12/2005 |
| WO | WO-2015/091678 | A1 | 6/2015 |
| WO | WO-2017/034792 | | 3/2017 |
| WO | WO-2017/034793 | | 3/2017 |

OTHER PUBLICATIONS

Covis, R., et al., Interactions and hybrid complex formation of anionic algal polysaccharides with a cationic glycine betaine-derived surfactant, Carbohydrate Polymers, vol. 121, Jan. 8, 2015, pp. 436-448.

Goursaud, F., et al., Glycine betaine as a renewable raw material to "greener" new cationic surfactants, Green Chemistry, Royal Society of Chemistry, GB, No. 10, Jan. 10, 2008, pp. 310-320.

Written Opinion for International Application PCT/US2016/061153, dated Feb. 3, 2017, 8 pages.

Matheson et al., "Peaked Distribution Ethoxylates—Their Preparation, Characterization and Performance Evaluation", Journal of American Oil Chemistry Society vol. 63, No. 3, Mar. 1986, pp. 365-370.

* cited by examiner

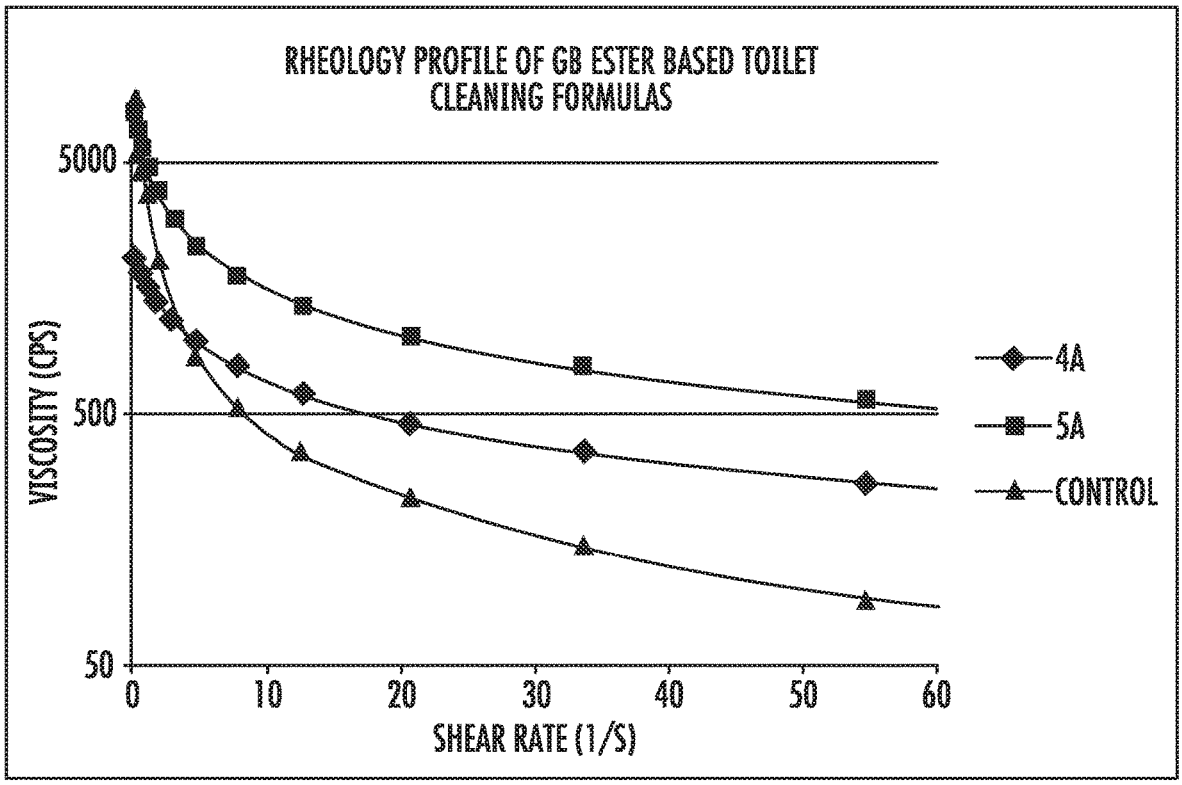
RHEOLOGY PROFILE OF GB ESTER BASED TOILET CLEANING FORMULAS
VISCOSITY (CPS)
5000
500
50
0
10
20
30
40
50
60
SHEAR RATE (1/S)
4A
5A
CONTROL

ACIDIC HARD SURFACE CLEANER WITH GLYCINE BETAINE ESTER

CROSS-REFERENCE TO RELATED APPLICATIONS

The present application is a national stage entry of International Patent Application No. PCT/US16/061153, filed on Nov. 17, 2016, which claims the benefit of and priority to U.S. Application No. 62/263,931, filed on Dec. 7, 2015, each of which is incorporated herein by reference in its entirety.

BACKGROUND

It would be advantageous to have cleaning compositions, which have a unique shear thinning profile. In particular, it may be desirable to have such compositions, which thin less after being sprayed onto a hard surface, e.g, of a shower or toilet, than conventional cleaning products. It may also be desirable for such compositions to be derived from natural products. Additionally, such compositions may advantageously exhibit sanitizing, disinfecting, biofilm prevention and disruption efficacy, and/or be compatible with a wide range of additional ingredients such as fragrance, dyes, and other cleaning agent auxiliary ingredients.

SUMMARY

The present application relates generally to the field of cleaning compositions and, in particular, cleaning compositions which may be especially useful for cleaning hard surfaces, such as the inside surface of a toilet bowl. The present application provides cleaning compositions, which may exhibit a unique shear thinning profile, such that the compositions thin less after being sprayed onto a surface and thereby provide a longer contact time than conventional cleaning products. The present cleaning compositions may include (a) a glycine betaine ester, (b) an acidifying agent, (c) polysaccharide thickener, and (d) water. Commonly, the composition has a pH of no more than about 4, a viscosity of no more than about 1,500 cP at a shear rate of 10 at 25° C., and/or a viscosity of at least about 150 cP at a shear rate of 50 at 25° C. (where the viscosities are determined with a Brookfield Cone/Plate viscometer). In certain embodiments, composition may have a 10/50 shear rate ratio of no more than about 3.

Often, the glycine betaine ester may be a compound of formula (I):

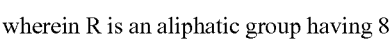

$$Me_3N^+—CH_2—C(O)—O—RX^- \quad (I)$$

wherein R is an aliphatic group having 8 to 22 carbon atoms and $X^-$ represents an inorganic or organic anion. Typically, $X^-$ represents an alkanesulphonate anion, such as a methanesulphonate anion.

In some embodiments, the cleaning composition may have a unique shear thinning profile, such that the composition thins less after being sprayed onto a surface and thereby provides a longer contact time than conventional products. In some embodiments, the composition may have a 10/50 shear rate ratio of no more than about 3.5, no more than about 3, or more desirably no more than about 2.5. As used herein, the term "10/50 shear rate ratio" refers to the ratio of the viscosity of the composition at a shear rate of 10 at 25° C. to the viscosity of the composition at a shear rate of 50 at 25° C. In some embodiments, the compositions may have a 10/50 shear rate ratio of about 2 to 3. In some embodiments, the composition may have a viscosity of at least about 1000 cP at a shear rate of 10 at 25° C. In some embodiments, the composition may have a viscosity of at least about 150 cP at a shear rate of 50 at 25° C. In some embodiments, the composition may have a viscosity of about 250 to 1,200 cP at a shear rate of 10 at 25° C. In some embodiments, the composition may have a viscosity of about 100 to 1000 cP, or at least about 150 cP and, in some instances, at least about 250 cP at a shear rate of 50 at 25° C.

The acidifying agent may include mineral acid, such as hydrochloric acid, an alkanesulphonic acid, such as methanesulfonic acid and/or one or more carboxylic acids, e.g., one or more hydroxycarboxylic acids. Nonlimiting examples of suitable hydroxycarboxylic acids include lactic acid, citric acid, tartaric acid, xylonic acid and gluconic acid. Examples of other suitable carboxylic acids include acetic acid, propionic acid, malonic acid, succinic acid and glutaric acid.

The polysaccharide thickener may include starch, modified starch, agar, carrageenan, pectin, alginate, pectin, cellulose, and/or a cellulose derivative. In some embodiments, the polysaccharide thickener may include a natural gum. In some embodiments, the polysaccharide thickener may include agar, carob gum, guar gum, gellan gum, xanthan gum, and/or acacia gum.

The cleaning composition may include other ingredients, such as one or more of an antimicrobial agent, a bleaching agent, a fragrance, and dye component. In some embodiments, in addition to the glycine betaine amide, the composition may optionally include an additional surfactant selected from nonionic, anionic, cationic, zwitterionic, and/or amphoteric surfactants and mixtures thereof.

In some embodiments, it may be advantageous to use a "crude" or "semi-purified" form of the glycine betaine ester. As used herein the term "crude" in reference to the glycine betaine ester is understood to mean the reaction product as formed from the reaction of glycine betaine with an aliphatic alcohol (typically a fatty alcohol) in the presence of an acid (typically methanesulfonic acid), i.e., the final reaction product as is, and used without further treatment or purification. The terms "semi-pure" or "semi-purified" in reference to the glycine betaine ester are understood to mean that the reaction product as originally formed is partly purified, i.e., residual glycine betaine, aliphatic alcohol and/or methanesulfonic acid are at least partially removed to provide a mixture which is still not a pure sample of the glycine betaine ester. Such "crude" or "semi-purified" glycine betaine ester components may be especially useful as surfactants in the present cleaning compositions. The "crude" and "semi-purified" glycine betaine ester components employed in the present cleaning compositions typically include at least 50 wt. % and, commonly, at least 60 wt. % of the glycine betaine ester.

In one embodiment, the cleaning compositions may include a mixture of a glycine betaine ester of Formula (I):

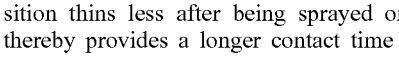

$$Me_3N^+—CH_2—C(O)—O—RX^- \quad (I)$$

wherein R is an aliphatic group having 8 to 22 carbon atoms and $X^-$ represents an inorganic or organic anion, and one or more of $Me_3N^+—CH_2—CO_2H\ X^-$ ("a glycine betaine salt"), an aliphatic alcohol ROH, where R is as defined, and an acid HX. Typically, $X^-$ represents an alkanesulphonate anion, such as a methanesulphonate anion and the acid HX is an alkanesulphonic acid, such as a methanesulphonic acid. As used herein, the term "glycine betaine salt" refers to the ionic compound $Me_3N^+—CH_2—CO_2H\ X^-$, where $X^-$ represents an inorganic or organic counterion, typically a methanesulphonate counterion. For example, a "crude" or "semi-purified" glycine betaine ester may include a glycine betaine ester of Formula (I) where R is a lauric group and one of more of glycine betaine methanesulphonate, lauric alcohol (ROH where R is a lauric group), and methanesulphonic acid.

In some embodiments, the compositions may be exhibit properties such as sanitizing, disinfecting, and/or biofilm prevention and disruption efficacy.

BRIEF DESCRIPTION OF THE DRAWINGS

FIG. 1 is a graph illustrating the rheology profiles of several of the present thickened cleaning compositions (Formula 7—"4a"; Formula 8—"5a") in comparison to a standard benchmark cleaning product (Standard 3—"control"), which contains a combination of a natural gum with an ethoxylated oxo alcohol and sodium lauryl ether sulfate.

DETAILED DESCRIPTION

In one aspect, the composition may be a liquid cleaning composition that includes (a) a glycine betaine ester of formula (I):

$$Me_3N^+—CH_2—C(O)—NH—RX^- \quad (I)$$

wherein R is an aliphatic group having 8 to 22 carbon atoms and $X^-$ represents an inorganic or organic anion; (b) an acidifying agent; (c) polysaccharide thickener; and (d) water. The composition may have a pH of no more than about 4, a viscosity of no more than about 1,500 cP at a shear rate of 10 at 25° C. and/or a viscosity of at least about 250 cP at a shear rate of 50 at 25° C. (viscosities determined with a Brookfield Cone/Plate viscometer). In some embodiments, the composition may include at least about 85 wt. %, at least about 90 wt. %, or often at least about 95 wt. % water.

Glycine betaine is a natural material derived from sugar beet molasses. The present glycine betaine esters may be derived from natural glycine betaine, providing a green (eco-friendly) and multifunctional material. Particularly of use is a glycine betaine ester of formula (I):

$$X^-Me_3N^+—CH_2—C(O)—O—R \quad (I),$$

wherein R may be an aliphatic group having 8 to 22 carbon atoms and $X^-$ represents an inorganic or organic counterion. The glycine betaine ester component of the present compositions may include one or more glycine betaine esters of formula (I). In some embodiments, R may be a linear or branched aliphatic group. In some embodiments, R may be a linear aliphatic group. In some embodiments, R may be an alkyl or an alkenyl group. In some embodiments, R may be an aliphatic group having 10 to 18 carbon atoms. In some embodiments, R may be a linear primary aliphatic group having 8 to 18 carbon atoms, e.g. an R group that is part of a fatty alcohol compound. In another embodiment, R may be an aliphatic group having 10 to 16 carbon atoms, such as the R group present in a $C_{10}$-$C_{16}$ linear primary alkyl alcohol. The R group may be a $C_8$, $C_{10}$, $C_{12}$, $C_{14}$, $C_{16}$, and/or $C_{18}$ aliphatic group, e.g., a $C_8$, $C_{10}$, $C_{12}$, $C_{14}$, $C_{16}$, and/or $C_{18}$ linear primary alkyl and/or alkenyl group. In some embodiments, R may be a $C_{10}$, $C_{12}$, $C_{14}$, and/or $C_{16}$ aliphatic group. In some embodiments, R may be a lauric, mystric, palmitic, stearic, and/or oleic group. In certain embodiments, R may include a lauric and/or mystric group. In some embodiments, R may be a $C_{12}$ and/or $C_{14}$ alkyl and/or alkenyl group. Examples of suitable inorganic or organic anions which may be present as the counterion, $X^-$, include halide, carboxylic acid, alkylcarbonate, alkylsulfonate, arylsulfonate, alkylsulfate, sulfate, nitrate, phosphate, and phosphite anions. In some embodiments, $X^-$ represents $Cl^-$, $Br^-$, $I^-$, $CH_3CO_2^-$, $CH_3CH(OH)CO_2^-$, $CH_3SO_3^-$, $ArSO_3^-$, $CH_3C_6H_4SO_3^-$, $CH_3OSO_3^-$, $H_2PO_4^-$, and/or $H_2PO_3^-$ anion. $X^-$ may be a halide or alkylsulfonate anion. In some embodiments, $X^-$ may be a chloride or methanesulfonate anion. As noted above, in glycine betaine esters derived from natural glycine betaine, $X^-$ may commonly be a methane sulfonate anion.

In some embodiments, $X^-$ represents $Cl^-$, $Br^-$, $I^-$, $CH_3CO_2^-$, $CH_3CH(OH)CO_2^-$, $CH_3SO_3$—, $ArSO_3^-$, $CH_3C_6H_4SO_3^-$, $CH_3OSO_3^-$, $H_2PO_4^-$, and/or $H_2PO_3^-$ anion. $X^-$ may be a halide or alkylsulfonate anion. In some embodiments, $X^-$ may be a chloride or methanesulfonate anion. As noted above, in glycine betaine esters derived from natural glycine betaine, $X^-$ may commonly be a methane sulfonate anion.

In many embodiments of the present compositions, the glycine betaine ester may be present in combination with an aliphatic alcohol (i.e., ROH) thereof, wherein R is as defined above. Often, aliphatic alcohol may be present as an unreacted starting material of the reaction used to produce the glycine betaine ester. In such cases, the "R group" of the aliphatic alcohol is commonly the same as the "R group" of the glycine betaine ester. The weight ratio of the glycine betaine ester to the aliphatic alcohol in the compositions may be about 10:1 to 1:5, more commonly about 5:1 to 1:2. In some embodiments, the glycine betaine ester may include a mixture of glycine betaine esters having R groups with 12 to 14 carbon atoms. The composition may also include one or more fatty alcohols with 12 to 14 carbon atoms in combination with such a glycine betaine ester. In some embodiments, the glycine betaine ester component may be an unpurified reaction product, which also includes glycine betaine and/or salt thereof. In some embodiments, such an unpurified reaction product may include methanesulfonic acid and/or salt thereof. In addition to the glycine betaine ester, in some embodiments the composition may further include an aliphatic amine, e.g. aliphatic $C_8$-$C_{22}$ amine, more typically a $C_8$-$C_{15}$ amine such as a $C_8$-$C_{14}$ fatty amine. For example, the composition may include a linear aliphatic $C_8$-$C_{18}$ amine in combination with the glycine betaine ester.

In some embodiments, in addition to the glycine betaine ester, the composition may also include a glycine betaine amide, e.g. a glycine betaine amide of formula (II):

$$X^-Me_3N^+—CH_2—C(O)—NH—R \quad (II),$$

wherein R and $X^-$ are as defined above.

The polysaccharide thickener may include starch, modified starch, agar, carrageenan, pectin, alginate, cellulose, and/or a cellulose derivative. In some embodiments, the polysaccharide thickener may include starch or a modified starch. In some embodiments, the polysaccharide thickener may include natural gum. Non-limiting examples of natural gum include agar, carob gum, guar gum, gellan gum, xanthan gum, and/or acacia gum. In some embodiments, the polysaccharide may desirably include xanthan gum and/or guar gum. In some embodiments, the composition may include about 0.1 to 5 wt. %, about 0.5 to 4 wt. %, or about 0.1 to 2 wt. % of one or more polysaccharide thickeners. For example, when the composition includes a natural gum as a thickener, the polysaccharide thickener may include about 0.1 to 1.5 wt. % and, more commonly about 0.2 to 1 wt. % xanthan gum and/or guar gum. When the composition includes starch and/or modified starch as a thickener, the composition may include about 2 to 4 wt. % of the polysaccharide thickener.

In some embodiments, composition may include other thickeners, such as rheology modifiers based on polyacrylates (including carbomers) and polyacrylamides; acrylamidomethylpropane sulfate including acryloyldimethyltaurates; PEG and polyol thickeners; cationic thickeners; cyclodextrin-based rheology modifiers; star polymers and dendrimers; polypeptide/protein thickeners; silicone thickeners; amphipathic polymers, synthetic associative thickeners, polymeric emulsifiers, gums from seaweed, gums produced by fermentation; chitin and derivatives and mineral thickeners. These other thickeners may be used in place of or in addition to the polysaccharide thickeners.

The acidifying agent may include mineral acid, such as hydrochloric acid, and/or one or more organic acids. For example, the acidifying agent may include an organic acid, such as lactic acid, glycolic acid, citric acid, acetic acid, malonic acid, succinic acid, tartaric acid gluconic acid, glutaric acid and/or methanesulfonic acid. In some embodiments, the acidifying agent may include a carboxylic acid, e.g., one or more hydroxycarboxylic acids. Non-limiting examples of suitable hydroxycarboxylic acids include lactic acid, citric acid, tartaric acid and gluconic acid. In some embodiments, the acidifying agent may include mineral acid, such as hydrochloric acid. In some embodiments, the acidifying agent may include methanesulfonic acid. In some embodiments, the acidifying agent may include lactic acid and/or citric acid. In some embodiments, the acidifying agent may include lactic acid. In some embodiments, the composition may include about 0.1 wt. % to 10 wt. %, about 0.5 wt. % to 10 wt. %, about 1 wt. % to 10 wt. %, or about 0.5 wt. % to 5 wt. % of one or more acidifying agents. In some embodiments, the composition may include at least about 1 wt. % of a mineral acid, such as hydrochloric acid, and may commonly include up to about 10 wt. % of the mineral acid (e.g., hydrochloric acid). In some embodiments, the composition may include at least about 1 wt. % and commonly about 1 to 5 wt. % of an organic acid. For example, the composition may include about 1 to 5 wt. % of an organic acid, which includes lactic acid, glycolic acid, citric acid, acetic acid, malonic acid, succinic acid, tartaric acid gluconic acid, glutaric acid and/or methanesulfonic acid. In many embodiments, the composition may include about 1 to 5 wt. % lactic acid. In other embodiments, the composition may include about 1 to 5 wt. % citric acid.

The cleaning composition may include one or more additional surfactants that are different from the glycine betaine ester selected from nonionic, anionic, cationic, zwitterionic, and/or amphoteric surfactants and mixtures thereof. In some embodiments, the composition may include one or more anionic and/or cationic surfactants. In some embodiments, the surfactants may be detersive surfactants. In some embodiments, the composition may include up to about 5 wt. %, about 0.1 wt. % to 3 wt. %, or about 0.1 to 2 wt. % of the additional surfactant.

The surfactants may include one or more alkoxylated alcohols. The alkoxylated alcohol may include one or more ethoxylated alcohols. Ethoxylated alcohols may be linear or branched. In some embodiments, the ethoxylated alcohol may include a $C_8$-$C_{16}$ alcohol having an average of 2 to 20 ethylene oxide units, more commonly 2 to 12 ethylene oxide units. Typically, when present, the ethoxylated alcohol includes a $C_9$-$C_{15}$ linear and/or branched alcohol having an average of 5 to 12 ethylene oxide units. A non-limiting example is Genapol® X-100 (available from CLARIANT), which is a branched iso-$C_{13}$ alcohol ethoxylate having an average of 10 ethylene oxide units. Other ethoxylated alcohols that may be present in the cleaning compositions as a nonionic surfactant include linear or branched ethoxylated alcohols including a $C_5$-$C_{15}$ alcohol having an average of 4 to 12 ethylene oxide units. Nonlimiting examples include Tomadol® 91-6—a $C_9$-$C_{11}$ ethoxylated alcohol having an average of 6 ethylene oxide units (available from Air Products and Chemicals, Inc.), LUTENSOL® AO-8—a synthetic $C_{13}$-$C_{15}$ ethoxylated oxo alcohol having an average of 8 ethylene oxide units (available from BASF), Genapol® LA 070S—an ethoxylated lauryl alcohol having an average of 7 ethylene oxide units (available from CLARIANT), and TERGITOL™ 15-S-7, a branched secondary ethoxylated alcohol with 7 ethylene oxide units (available from DOW Chemical). Other examples of suitable ethoxylated linear alcohols include ethoxylated linear alcohols having a $C_{10}$-$C_{15}$ n-alkyl group, e.g., having an average of 2 to 12 ethylene oxide units. Nonlimiting examples include LUTENSOL® TDA 10 (available from BASF)—an ethoxylated tridecyl alcohol having an average of 10 EO groups. Triglyceride derivatives such as ethoxylated triglycerides having an average of 2 to 10 ethylene oxide units may also be used (e.g., such compounds are available from BASF or Rhodia).

Other nonionic surfactants which may be present include, but are not limited to, secondary ethoxylated alcohols, such as $C_{11}$-$C_{15}$ secondary ethoxylated alcohols. Secondary ethoxylated alcohols suitable for use are sold under the tradename TERGITOL® (available from Dow Chemical). For example TERGITOL® 15-S, more particularly TERGITOL® 15-S-12 is a $C_{11}$-$C_{15}$ secondary ethoxylate alcohol having an average of about 12 ethylene oxide groups.

Additional suitable nonionic surfactants include linear alkyl amine oxides. Typical linear alkyl amine oxides include water-soluble amine oxides of the formula $R^1$—N($R^2$)($R^3$)O where $R^1$ is typically a $C_8$-$C_{18}$ alkyl moiety and the $R^2$ and $R^3$ moieties are typically selected from the group consisting of hydrogen, $C_1$-$C_3$ alkyl groups, and $C_1$-$C_3$ hydroxyalkyl groups. Quite often, $R^1$ is a $C_8$-$C_{18}$ n-alkyl and $R^2$ and $R^3$ are methyl, ethyl, propyl, isopropyl, 2-hydroxyethyl, 2-hydroxypropyl, and/or 3-hydroxypropyl. The linear amine oxide surfactants in particular may include linear $C_{10}$-$C_{18}$ alkyl dimethyl amine oxides and linear $C_8$-$C_{12}$ alkoxy ethyl di(hydroxyethyl) amine oxides. Particularly suitable amine oxides include linear $C_{10}$, linear $C_{10}$-$C_{12}$, and linear $C_{12}$-$C_{14}$ alkyl dimethyl amine oxides. Other examples of amine oxide nonionic surfactants include alkyl amidopropyl amine oxides, such as lauryl/myristyl amidopropyl amine oxides (e.g., lauryl/myristyl amidopropyl dimethylamine oxide).

In some embodiments, the cleaning composition may include one or more bases. In some embodiments, the base may be an organic base such as an alkylamine including triethylamine and heterocyclic amines such as pyrrole, pyridine, and piperdine. In some embodiments, the base may be an inorganic base including alkali metals and alkaline earth metal bases such as NaOH, LiOH, KOH, $Mg(OH)_2$, and $Ca(OH)_2$. The cleaning composition may include up to about 5 wt. % of one or more bases. In some embodiments, the cleaning composition may include about 0.001 wt. % to 3 wt. %, about 0.01 wt. % to 1 wt. %, or more preferably about 0.05 wt. % to 0.5 wt. % of one or more bases.

The cleaning composition may include other ingredients including adjuvants. As used herein, adjuvants include components or agents, such as additional functional materials. In some embodiments, the functional materials may be included to provide desired properties and functionalities to the cleaning composition. For the purpose of this application, the term "functional materials" include a material that when dispersed or dissolved in a concentrate and/or use solution, such as an aqueous solution, provides a beneficial property in a particular use. The present compositions may optionally include other soil-digesting components, surfactants, disinfectants, detergent fillers, sanitizers, acidulants, complexing agents, biocides and/or antimicrobial agents, corrosion inhibitors, anti-redeposition agents, foam inhibitors, opacifying agents such as titanium dioxide, dyes, bleaching agents (e.g., hydrogen peroxide and other peroxides), enzymes, enzyme stabilizing systems, builders, thickening or gelling agents, wetting agents, dispersants, stabilizing agents, dispersant polymers, cleaning compounds, pH adjusting agents (acids and alkaline agents), stain preventers, and/or fragrances. In some embodiments, the composition may include one or more of an antimicrobial agent, a bleaching agent, a fragrance, and/or dye component. In some embodiments, the composition may include up to about 1 wt. %, about 0.05 to 0.5 wt. %, or about 0.1 to 0.3 wt. % of a fragrance component. In some embodiments, the composition may include up to about 1 wt. %, about 0.001 to 0.5 wt. %, or about 0.01 to about 0.1 wt. % of one or more dye components.

In some embodiments, the composition may include: about 0.1-3 wt. % of the glycine betaine ester; about 0.5-10 wt. % of the acidifying agent; about 0.5-5 wt. % of the polysaccharide thickener; and at least about 85 wt. %, more commonly at least about 90 wt. % water.

In some embodiments, the composition may include: (a) about 0.1-3 wt. % of the glycine betaine ester; (b) about 0.5-5 wt. % of the acidifying agent; (c) about 0.5-3 wt. % of the polysaccharide thickener; and (d) at least about 90 wt. %, more commonly at least about 95 wt. % water.

In some embodiments, the composition may include: about 0.1-3 wt. % of the glycine betaine ester; about 0.5-5 wt. % of an acidifying agent, which may include a hydroxycarboxylic acid, e.g. lactic and/or citric acid, and/or acetic acid; about 0.1-1 wt. % of the polysaccharide thickener, which may include a natural gum; and at least about 90 wt. %, more commonly at least about 95 wt. % water.

In some embodiments, the composition may include: about 0.1-3 wt. % of the glycine betaine ester; about 0.5-10 wt. % of the acidifying agent, which may include a mineral acid; about 0.1-1 wt. % of the polysaccharide thickener, which may include a natural gum; and at least about 90 wt. %, more commonly at least about 95 wt. % water.

In some embodiments, the composition may include: about 0.1-3 wt. % of the glycine betaine ester; about 0.5-10 wt. % of the acidifying agent, which may include a mineral acid; about 0.5-4 wt. % of the polysaccharide thickener, which may include starch and/or a modified starch; and at least about 90 wt. %, more commonly at least about 95 wt. % water.

In some embodiments, the composition may include: about 0.1-3 wt. % of the glycine betaine ester; about 0.5-5 wt. % of the acidifying agent, which may include a hydroxycarboxylic acid, e.g. lactic and/or citric acid; about 0.5-4 wt. % of the polysaccharide thickener, which may include starch and/or a modified starch; and at least about 90 wt. %, more commonly at least about 95 wt. % water.

As used herein, "composition" refers to any liquid, foam, solid, gel, and/or paste substance having more than one component.

As used herein, "fragrance" refers to any perfume, odor-eliminator, odor masking agent, the like, and combinations thereof. In some embodiments, a fragrance is any substance which may have an effect on a consumer, or user's, olfactory senses.

As used herein, "wt. %" refers to the weight percentage of an ingredient in the total formula. For example, an off-the-shelf commercial composition of Formula X may only contain 70% active ingredient X. Thus, 10 g of the off-the-shelf composition only contains 7 g of X. If 10 g of the off-the-shelf composition is added to 90 g of other ingredients, the wt. % of X in the final formula is thus only 7%.

As used herein, "hard surface" refers to any porous and/or non-porous surface. In one embodiment, a hard surface may be selected from the group consisting of: ceramic, glass, metal, polymer, stone, and combinations thereof. For the purposes of this application, a hard surface does not include silicon wafers and/or other semiconductor substrate materials. Nonlimiting examples of ceramic surfaces include: toilet bowl, sink, shower, tile, the like, and combinations thereof. A non-limiting example of a glass surfaces includes: window and the like. Nonlimiting examples of metal surfaces include: drain pipe, sink, the like. Nonlimiting examples of a polymeric surface includes: PVC piping, fiberglass, acrylic, Corian®, the like. A non-limiting example of a stone hard surface includes: granite, marble, and the like.

A hard surface may be any shape, size, or have any orientation that is suitable for its desired purpose. In one non-limiting example, a hard surface may be oriented in a vertical configuration. In another non-limiting example, a hard surface may be the surface of a curved surface, such as a ceramic toilet bowl. In yet another non-limiting example, a hard surface may be the inside of a pipe, which has vertical and horizontal elements, and also may have curved elements. It is thought that the shape, size and/or orientation of the hard surface will not affect the compositions of the present invention, because of the unexpectedly strong transport properties of the compositions under the conditions described infra.

As used herein, "surfactant" refers to any agent that lowers the surface tension of a liquid, for example water. Exemplary surfactants which may be suitable for use with the present invention are described herein. In one embodiment, surfactants may be selected from the group consisting of anionic, non-ionic, cationic, amphoteric, zwitterionic, and combinations thereof.

As used herein, "viscosity" refers to the resistance to gradual deformation by shear stress or tensile stress of a composition. The rheology profiles (determined at shear rates from 1-100 $sec^{-1}$) of all viscous formula were measured at 25° C. using a TA AR 2000 rheometer equipped with a 4 cm stainless steel parallel plate and Peltier plate at a shear of 1 to 100 $sec^{-1}$. In other instances, viscosity values were measured using a Brookfield rheometer at 25° C. using a spindle of 2 and 12 RPM.

EXAMPLES

The following examples are intended to more specifically illustrate the present cleaning compositions according to various embodiments described above. These examples should in no way be construed as limiting the scope of the present technology.

A number of exemplary formulations of the present cleaning compositions were prepared and are presented in Tables 1-4 below. For all formulations, the balance of the formulation was water. The ability of the test formulations to remove lime scale and organic soil from a hard surface was determined using the procedures described below.

Lime Scale Removal Test

The effectiveness of the present cleaning compositions to remove lime scale from a hard surface was determined using the following procedure. Marble chips were used to simulate lime scale. Testing procedures are designed to provide a simulation of conditions that would commonly be found in toilets containing lime scale. The time required to complete this test is 48 hours. Total time required for test, including preparation of materials is 3 days. Approximately 5 grams of marble chips are rinsed with Deionized water for 3 minutes and drained. The marble chips are baked in oven set at 40+/−2° C. for 48 hours and cool at room conditions for 2 hours+/−15 minutes. The formulation being tested (100 g of per 5.00 g of marble chips) are stored at room conditions in contact with the marble chips undisturbed for eighteen hours. The marble chips are then drained and rinsed under deionized water for 30 seconds to remove excess formula. The marble chips are then dried again in an oven at 400+/−2° C. for 48 hours, cooled to room temperature (~2 hours+/−15 min) and weighed. The percentage weight loss is calculated according to the formula below and report as % lime scale removal. The value reported is an average of 3 separate results.

$$(W_j - W_f \times 100)/W_i.$$

where; $W_i$=initial weight of marble chips; $W_f$=final weight of marble chips.

Organic Soil Removal Test

The effectiveness of the present cleaning compositions to remove organic soil from a hard surface was determined using the following procedure. To measure the ability of a liquid toilet bowl cleaner to remove organic stains, colorimeter readings (L, a, b values) are taken on clean ceramic tiles through a piece of glass that is mounted on a jig. A silkscreen is used to apply the organic soil to the ceramic tiles. Colorimeter readings are taken immediately after the organic soil is applied (organic soil should be wet). Product is allowed to dwell on the surface of the soiled tile for 1 minute. A scrubber with a brush attachment is then used to scrub the tile three times (3 passes). Cleaning efficacy or percent soil removed is determined by using the measured colorimeter readings before and after treatment with the liquid toilet bowl cleaner in the equation below.

$$\text{Percent Soil Removal} = 100 * \frac{\sqrt{((L_s - L_c)^2 + (a_s - a_c)^2 + (b_s - b_c)^2)}}{\sqrt{((L_s - L_n)^2 + (a_s - a_n)^2 + (b_s - b_n)^2)}}$$

where s=soiled tile reading; n=non-soiled tile reading; and c=cleaned tile reading.

Example 1

Table 1 lists several exemplary formulations of the present cleaning product and demonstrates that the present compositions (with lactic acid as an acidifying agent) are more effective at removing lime scale and organic soil compared to a standard benchmark formulation. A standard thickened cleaning product which contains a combination of 59 wt. % of a synthetic $C_{13}$-$C_{15}$ ethoxylated oxo alcohol having an average of 8 ethylene oxide units (LUTENSOL® AO-8) and 41 wt. % sodium lauryl ether sulfate ("SLES") as the surfactant component.

TABLE 1

| | Standard 1 | Formula 1 | Formula 2 | Formula 3 |
|---|---|---|---|---|
| Surfactant | Lutensol A08/ Na LES | Crude $C_{12}/C_{14}$-GB Ester* | Crude $C_{12}/C_{14}$-GB Ester | Crude $C_{12}/C_{14}$-GB Ester |
| Surfactant Conc. (wt %) | 1.35 | 1.35 | 0.40 | 0.40 |
| Lactic Acid (wt %) | 2.02 | 2.06 | 1.89 | 1.90 |

TABLE 1-continued

| | Standard 1 | Formula 1 | Formula 2 | Formula 3 |
|---|---|---|---|---|
| Polysaccharide Thickener wt % | 0.43 xanthan gum | 0.43 xanthan gum | 0.5 xanthan gum | 1.00 guar gum |
| NaOH (wt. %) | 0.010 | 0.012 | 0.014 | — |
| Fragrance (wt. %) | 0.18 | 0.18 | 0.18 | 0.18 |
| Dye (wt. %) | 0.005 | 0.005 | 0.005 | 0.005 |
| pH | 2.23 | 1.85 | 1.90 | 1.85 |
| Lime scale removal (%) | 7.6 | 21 | 12 | 10 |
| Organic soil removal (%) | 65 | 85 | 78 | 84 |

*66% $C_{12}/C_{14}$-GB Ester/3% $C_{12}/C_{14}$-Alcohol/31% Methane Sulfonic Acid Table 1 includes a standard benchmark formulations (Standard 1) that does not include glycine betaine ester and three formulations with a varying amount of crude glycine betaine $C_{12}/C_{14}$ ester, lactic acid (as an acidifying agent), and a natural gum thickener (xanthan gum or guar gum). Table 1 demonstrates that the formulations of the present compositions are considerably better at removing both organic soil and lime scale. Particularly notable is Formula 1, which is about 3 times better at removing lime scale than the standard benchmark formulation as well as substantially more effective at organic soil removal. Formula 1 contains the same amount of surfactant, lactic acid, and xanthan gum as the standard formulation. These formulas demonstrate that glycine betaine ester cleaning formulations with lactic acid and either xanthan gum or guar gum as a thickener provide more efficient cleaning compositions with the same or decreased amount of surfactant compared to the standard benchmark formulation.

Example 2

Table 2 lists several additional exemplary formulations of the present cleaning product. A standard thickened cleaning product which contains a combination of LUTENSOL® AO-8 and Na LES as the surfactant component was tested for comparison purposes. The results demonstrate that the present compositions (with lactic acid as an acidifying agent) are more effective at removing lime scale and organic soil compared to a standard benchmark formulation. The performance of Formula 6, which includes a comparable amount of surfactant compared to the standard formulation with hydrochloric acid as an acidifying agent, was particularly effective.

TABLE 2

| | Standard 2 | Formula 4 | Formula 5 | Formula 6 |
|---|---|---|---|---|
| Surfactant | Lutensol A08/ Na LES | Crude $C_{12}/C_{14}$-GB Ester* | Crude $C_{12}/C_{14}$-GB Ester | Crude $C_{12}/C_{14}$-GB Ester |
| Surfactant Conc. (wt. %) | 1.35 | 0.40 | 0.40 | 1.28 |
| Lactic Acid (wt. %) | 2.02 | 1.9 | 2.02 | 4.2 {HCL} |
| Polysaccharide Thickener wt. % | 0.43 xanthan gum | 1 guar gum | 1 guar gum | 0.94 guar gum |
| NaOH (wt. %) | 0.01 | — | — | — |
| pH | 2.23 | 1.85 | 1.90 | 0.48 |
| Lime scale removal (%) | 8.2 | 10.2 | 11.3 | 38.6 |
| Organic soil removal (%) | 73 | 84 | — | 79 |

*66% $C_{12}/C_{14}$-GB Ester/3% $C_{12}/C_{14}$-Alcohol/31% Methane Sulfonic Acid Example 3

Table 3 lists several additional exemplary formulations of the present cleaning product in comparison to a standard thickened cleaning product containing a combination of LUTENSOL® AO-8 and Na LES as the surfactant component.

TABLE 3

| | Standard 3 | Formula 7 | Formula 8 |
|---|---|---|---|
| Surfactant | Lutensol A08/ Na LES | Crude $C_{12}/C_{14}$-GB Ester* | Crude $C_{12}/C_{14}$-GB Ester |
| Surfactant Conc. (wt %) | 1.35 | 0.4 | 1 |
| Lactic Acid (wt %) | 2.02 | 2.3 | 2.3 |
| Polysaccharide Thickener wt % | 0.4 xanthan gum | 0.7 guar gum | 1 guar gum |
| NaOH (wt. %) | 0.010 | — | — |
| Fragrance (wt. %) | 0.18 | 0.2 | 0.2 |
| Dye (wt. %) | 0.005 | 0.027 | 0.027 |

*66% $C_{12}/C_{14}$-GB Ester/3% $C_{12}/C_{14}$-Alcohol/31% Methane Sulfonic Acid FIG. 1 shows the rheology profiles of the two GB Ester-based compositions listed in Table 3. These two formulations exemplifying the present cleaning products containing a combination of GB Ester and natural gum (Formula 7—"4a"; Formula 8—"5a") have rheology profiles which exhibit less shear thinning than observed with the standard benchmark cleaning product (Standard 3—"control"), which contains a combination of a natural gum with an ethoxylated oxo alcohol and sodium lauryl ether sulfate.

Example 4

Table 4 lists several additional exemplary formulations of the present cleaning product containing starch as the polysaccharide thickening agent in comparison to a standard thickened cleaning product containing a combination of LUTENSOL® AO-8 and Na LES as the surfactant component.

TABLE 4

| | Standard 2 | Formula 9 | Formula 10 |
|---|---|---|---|
| Surfactant | Lutensol A08/ SLES | Crude $C_{12}/C_{14}$-GB Ester* | Crude $C_{12}/C_{14}$-GB Ester |
| Surfactant Conc. (wt %) | 1.35 | 0.78 | 0.6 |
| Lactic Acid (wt %) | 2.02 | 1.9 | 1.9 |
| Starch (wt %) | 0.43 {xanthan gum} | 3.6 | 3.0 |
| NaOH (wt. %) | 0.01 | — | — |
| pH | 2.23 | 1.6 | 1.6 |
| Viscosity (cP) | — | 1206 | 1218 |

*66% $C_{12}/C_{14}$-GB Ester/3% $C_{12}/C_{14}$-Alcohol/31% Methane Sulfonic Acid Illustrative Embodiments Reference is made in the following to a number of illustrative embodiments of the subject matter described herein. The following embodiments describe illustrative embodiments that may include various features, characteristics, and advantages of the subject matter as presently described. Accordingly, the following embodiments should not be considered as being comprehensive of all of the possible embodiments or otherwise limit the scope of the methods, materials and compositions described herein.

In one aspect, the present technology provides a liquid cleaning composition including (a) a glycine betaine ester of formula (I):

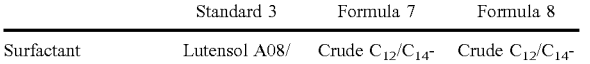

$$Me_3N^+—CH_2—C(O)—O—RX^- \quad (I)$$

wherein R is an aliphatic group having 8 to 22 carbon atoms; (b) an acidifying agent; (c) polysaccharide thickener; and (d) water; wherein the composition may have a pH of no more than about 4, a viscosity of no more than about 1,500 cP at a shear rate of 10 at 25° C., and a viscosity of at least about 250 cP at a shear rate of 50 at 25° C. (viscosities determined with a brookfield cone/plate viscometer); and $X^-$ represents an inorganic or organic counterion.

In some embodiments, the composition may further include an aliphatic alcohol ROH, wherein the R group is as defined herein. In some embodiments, the weight ratio of the glycine betaine ester to the aliphatic alcohol may be about 20:1 to 1:2, more commonly about 10:1 to 2:1. The glycine betaine ester may include a mixture of glycine betaine esters having R groups with 12 carbon atoms and 14 carbon atoms; and the composition may further include a mixture of fatty alcohols (ROH) having R groups with 12 carbon atoms and 14 carbon atoms. In some embodiments, the R group is the aliphatic group of a fatty alcohol. In some embodiments, the R group may be an aliphatic group of a $C_{10}$, $C_{12}$, $C_{14}$, and/or $C_{16}$ alkyl group. In some embodiments, the R group may be a $C_{10}$-$C_{16}$ aliphatic group. In some embodiments, the R group may be a $C_8$-$C_{22}$ linear aliphatic group. In some embodiments, the R group may be a $C_8$, $C_{10}$, $C_{12}$, $C_{14}$, $C_{16}$ and/or $C_{18}$ alkyl group and/or an oleic group. In some embodiments, the R group may be a lauric, myristic, palmitic, stearic, and/or oleic group. In some embodiments, the R group may be an aliphatic group of a linear primary amine having 8 to 18 carbon atoms. In some embodiments, the $X^-$ represents a methanesulfonate anion. In some embodiment, the $X^-$ represents a methanesulfonate anion and the R group includes a lauric and/or myristic group.

The polysaccharide thickener may include xanthan gum and/or guar gum. In some embodiments, the polysaccharide may include starch or a modified starch. In some embodiments, the polysaccharide thickener includes starch, modified starch, agar, carrageenan, pectin, alginate, pectin, cellulose, and/or a cellulose derivative. The polysaccharide thickener may include a natural gum. In some embodiments, the natural gum may include agar, carob gum, guar gum, gellan gum, xanthan gum, and/or acacia gum.

In some embodiments, the acidifying agent may include a mineral acid, such as hydrochloric acid. In some embodiments, the acidifying agent may include a carboxylic acid, e.g., acetic acid and/or a hydroxycarboxylic acid. The hydroxycarboxylic acid may include lactic acid, citric acid, tartaric acid, gluconic acid, and/or glutaric acid. In some embodiments, the acidifying agent may include lactic acid and/or citric acid.

In some embodiments, the composition may include: about 0.1-15 wt. % of the glycine betaine ester; about 0.5-10 wt. % of the acidifying agent; about 0.5-5 wt. % of the polysaccharide thickener; and at least about 90 wt. % water. In some embodiments, the composition may include: (a) about 0.1-5 wt. % of the glycine betaine ester; (b) about 0.5-10 wt. % of the acidifying agent; (c) about 0.5-5 wt. % of the polysaccharide thickener; and (d) at least about 90 wt. % water. In some embodiments, the composition may include: about 0.1-3 wt. % of the glycine betaine ester; about 0.5-5 wt. % of the acidifying agent, which may include a hydroxycarboxylic acid; about 0.5-3 wt. % of the polysaccharide thickener, which may include a natural gum; and at least about 90 wt. % water. In some embodiments, the composition may include: about 0.1-3 wt. % of the glycine betaine ester; about 0.5-10 wt. % of the acidifying agent, which may include a mineral acid; about 0.5-5 wt. % of the polysaccharide thickener, which may include starch and/or a modified starch; and at least about 90 wt. % water. In some embodiments, the composition may include: about 0.1-3 wt. % of the glycine betaine ester; about 0.5-5 wt. % of the acidifying agent, which may include a hydroxycarboxylic acid; about 0.5-5 wt. % of the polysaccharide thickener, which may include starch and/or a modified starch; and at least about 90 wt. % water.

In some embodiments, in addition to the glycine betaine ester, the composition may further include a glycine betaine amide of formula (II):

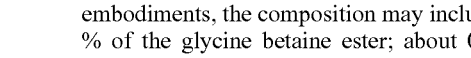

$$Me_3N^+—CH_2—C(O)—NH—RY^- \quad (II)$$

wherein R is an aliphatic group having 8 to 22 carbon atoms; and $Y^-$ represents an inorganic or organic counterion.

In some embodiments, the composition may further include methanesulfonic acid and/or glycine betaine and/or a salt thereof.

In some embodiments, the composition may have a viscosity of about 250 to 1,200 cP at a shear rate of 10 at 25° C. The composition may have a viscosity of about 150 to 1000 cP at a shear rate of 50 at 25° C. In some embodiments, the composition may have a 10/50 shear rate ratio of no more than about 3. In some embodiments, the composition may have a 10/50 shear rate ratio of no more than about 2.5.

In some embodiments, the composition may include: (a) about 0.1-1 wt. % of the glycine betaine ester; (b) about 1-4 wt. % of the acidifying agent, which may include lactic and/or citric acid; (c) about 0.2-1 wt. % of a natural gum thickener; and (d) at least about 95 wt. % water. Such a composition may have a pH of no more than about 3, a 10/50 shear rate ratio of no more than about 3, and/or a viscosity of at least about 250 at a shear rate of 50 at 25° C.

In some embodiments, the composition may include: (a) about 0.1-1 wt. % of the glycine betaine ester; (b) about 1-10 wt. % of the acidifying agent, which may include lactic and/or citric acid; (c) about 1-4 wt. % of a thickener, which may include starch and/or a modified starch; and (d) at least about 90 wt. % water. Such a composition may have a pH of no more than about 3, a 10/50 shear rate ratio of no more than about 3, and/or a viscosity of at least about 250 at a shear rate of 50 at 25° C.

In some embodiments, the composition may include: (a) about 0.1-1 wt. % of the glycine betaine ester; (b) about 1-10 wt. % of an acidifying agent, which may include hydrochloric acid; (c) about 0.2-1 wt. % of a natural gum thickener; and (d) at least about 90 wt. % water. Such a composition may have a pH of no more than about 1.5 (typically no more than about 1), a 10/50 shear rate ratio of no more than about 3, and/or a viscosity of at least about 250 at a shear rate of 50 at 25° C.

In some embodiments, the present liquid cleaning composition may comprise (a) a glycine betaine ester of formula (I):

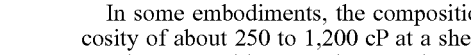

$$Me3N^+—CH2\text{-}C(O)—O—RX^- \quad (I)$$

wherein R is an aliphatic group having 8 to 22 carbon atoms; and $X^-$ represents an inorganic or organic counterion;

(b) about 1-10 wt. % acidifying agent, which includes a mineral acid;

(c) polysaccharide thickener; and (d) water; wherein the composition has a pH of no more than about 1. The mineral acid typically comprises hydrochloric acid, e.g., at least about 1 wt. % hydrochloric acid.

In some embodiments, the composition may include: (a) about 0.1-1 wt. % of the glycine betaine ester; (b) about 1-10 wt. % of the acidifying agent, which may include hydrochloric acid; (c) about 1-4 wt. % of a thickener, which may include starch and/or a modified starch; and (d) at least about 85 wt. % water. Such a composition may have a pH of no more than about 1.5, typically no more than about 1, a 10/50 shear rate ratio of no more than about 3, and/or a viscosity of at least about 250 at a shear rate of 50 at 25° C.

In some embodiments, the present composition may be a liquid cleaning composition which includes (a) a glycine betaine ester of formula (I):

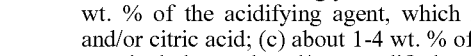

$$Me_3N^+—CH_2—C(O)—O—RX^- \quad (I)$$

wherein R is an aliphatic group having 8 to 22 carbon atoms; and X represents an inorganic or organic counterion; (b) an acidifying agent; (c) polysaccharide thickener; and (d) water. The composition may have a pH of no more than about 3, a 10/50 shear rate ratio of no more than about 3, and/or a viscosity of at least about 250 at a shear rate of 50 at 25° C. In certain embodiments, the composition may include about 0.1-3 wt. % of the glycine betaine amide; about 0.1-3 wt. % of the acidifying agent; about 0.1-4 wt. % of the polysaccharide thickener; and at least about 90 wt. % water. The acidifying agent may include an organic acid, such as lactic acid, glycolic acid, citric acid, acetic acid, malonic acid, succinic acid, tartaric acid gluconic acid, glutaric acid and/or methanesulfonic acid.

While certain embodiments have been illustrated and described, it should be understood that changes and modifications can be made therein in accordance with ordinary skill in the art without departing from the technology in its broader aspects.

The embodiments, illustratively described herein may suitably be practiced in the absence of any element or elements, limitation or limitations, not specifically disclosed herein. Thus, for example, the terms "comprising," "including," "containing," shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term.

The use of the terms "a" and "an" and "the" and similar referents in the context of describing the elements (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be per-formed in any suitable order unless otherwise indicated herein or otherwise clearly contradicted by context. The use of any and all examples, or exemplary language (e.g., "such as") provided herein, is intended merely to better illuminate the embodiments and does not pose a limitation on the scope of the claims unless otherwise stated. No language in the specification should be construed as indicating any non-claimed element as essential.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible subranges and combinations of subranges thereof.

What is claimed is:

1. A liquid, aqueous cleaning composition consisting of:

(a) about 0.5 to 3 wt. % a glycine betaine ester of formula (I):

$$Me_3N^+—CH_2—C(O)—O—RX^- \quad (I)$$

wherein R is an aliphatic group having 8 to 22 carbon atoms; and $X^-$ represents an inorganic or organic counterion;

(b) hydrochloric acid as an acidifying agent;

(c) about 0.1-2 wt. % of a polysaccharide thickener, which consists of guar gum and optionally one or more other polysaccharide thickeners;

(d) an aliphatic alcohol ROH, wherein the R group is an aliphatic group having 8 to 22 carbon atoms;

(e) methanesulfonic acid and/or a salt thereof; and (f) at least about 85 wt. % water; and (f) optionally, one or more of an antimicrobial agent, a fragrance, and a dye component;

wherein the composition has a pH of no more than 1, a viscosity of no more than about 1,500 cP at a shear rate of 10 at 25° C., and a viscosity of at least about 150 cP at a shear rate of 50 at 25° C. (viscosities determined with a Brookfield Cone/Plate viscometer).

2. The composition of claim 1, wherein the weight ratio of the glycine betaine ester to the aliphatic alcohol is about 10:1 to 1:2.

3. The composition of claim 1, wherein the one or more other polysaccharide thickeners consists of starch and/or a modified starch.

4. The composition of claim 1, wherein the one or more other polysaccharide thickeners consists of a natural gum selected from one or more of agar, carob gum, gellan gum, xanthan gum, and acacia gum.

5. The composition of claim 1, wherein the composition consists of:

about 0.1-3 wt. % of the glycine betaine ester;

about 0.5-5 wt. % of the hydrochloric acid;

about 0.1-1.5 wt. % of the polysaccharide thickener;

the aliphatic alcohol ROH;

the methanesulfonic acid and/or salt thereof; and at least about 90 wt. % water;

wherein the $X^-$ is a methanesulfonate anion.

6. The composition of claim 1, wherein the glycine betaine ester is a mixture of glycine betaine esters having R groups with 12 carbon atoms and 14 carbon atoms; and the aliphatic alcohol is a mixture of fatty alcohols ROH having R groups with 12 carbon atoms and 14 carbon atoms.

7. The composition of claim 6, wherein the R group is a mixture of lauric and myristic groups.

8. The composition of claim 7, wherein the composition has a viscosity of about 500 to 1,500 cP at a shear rate of 10 at 25° C., a viscosity of about 150 to 1000 cP at a shear rate of 50 at 25° C. and a 10/50 shear rate ratio of no more than about 2.5.

9. A liquid, aqueous cleaning composition consisting of:

(a) about 0.5-3 wt. % of a glycine betaine ester of formula (I):

$$Me_3N^+—CH_2—C(O)—O—RX \quad (I)$$

wherein R is one or more aliphatic groups having 12 or 14 carbon atoms; and $X^-$ represents an inorganic or organic counterion;

(b) about 1-10 wt. % hydrochloric acid;

(c) about 0.1-2 wt. % of a polysaccharide thickener, which comprise consists of guar gum and optionally one or more other polysaccharide thickeners;

(d) an aliphatic alcohol ROH, wherein the R group is an aliphatic group having 12 or 14 carbon atoms; and (e) methanesulfonic acid and/or a salt thereof; and (f) at least about 85 wt. % water; and optionally, one or more of an antimicrobial agent, a fragrance, and a dye component;

wherein the composition has a pH of no more than 1 and a viscosity of no more than about 1,500 cP at a shear rate of 10 at 25° C.; and the weight ratio of the glycine betaine ester to the aliphatic alcohol is about 20:1 to 1:2.

10. The composition of claim 9, wherein the $X^-$ is a methanesulfonate anion.

11. The composition of claim 1, wherein the composition contains about 1 to 10 wt. % of the hydrochloric acid.

12. The composition of claim 9, wherein the composition has a viscosity of at least about 150 cP at a shear rate of 50 at 25° C. (viscosities determined with a Brookfield Cone/Plate viscometer).

13. The composition of claim 9, wherein the composition has a 10/50 shear rate ratio of no more than about 3, and a viscosity of at least about 250 at a shear rate of 50 at 25° C.

14. The composition of claim 9 consisting of:

(a) the glycine betaine ester;

(b) about 1-5 wt. % of the hydrochloric acid;

(c) the polysaccharide thickener;

(d) the aliphatic alcohol ROH;

(e) the methanesulfonic acid and/or salt thereof; and (f) at least about 90 wt. % water;

wherein the one or more other polysaccharide thickeners consists of a natural gum thickener selected from agar, carob gum, gellan gum, xanthan gum, and/or acacia gum; and the composition has a 10/50 shear rate ratio of no more than about 3, and a viscosity of at least about 250 at a shear rate of 50 at 25° C.

15. The composition of claim 9 consisting of:

(a) the glycine betaine ester;

(b) about 1-5 wt. % of the hydrochloric acid;

(c) about 0.1-2 wt. % of the guar gum;

(e) the methanesulfonic acid and/or salt thereof; and (f) at least about 90 wt. % water;

wherein the composition has a 10/50 shear rate ratio of no more than about 3, and a viscosity of at least about 250 at a shear rate of 50 at 25° C.; and the $X^-$ is a methanesulfonate anion.

16. The composition of claim 15, wherein the R group is a lauric and/or myristic group.

17. The composition of claim 1, wherein the R group is a palmitic, stearic, and/or oleic group.

18. A liquid, aqueous cleaning composition consisting of:

(a) about 0.5 to 3 wt. % a glycine betaine ester of formula (I):

$$Me_3N^+—CH_2—C(O)—O—RX^- \quad (I)$$

wherein R is a $C_{10}$-$C_{16}$ linear primary alkyl; and $X^-$ represents an inorganic or organic counterion;

(b) about 1-10 wt. % hydrochloric acid;

(c) about 0.5-3 wt. % of a polysaccharide thickener, which consists of guar gum and optionally one or more other polysaccharide thickeners;

(d) an alcohol ROH, wherein the R group is a $C_{10}$-$C_{16}$ linear primary alkyl group;

(e) methanesulfonic acid and/or a salt thereof; and (f) at least about 85 wt. % water; and (f) optionally, one or more of an antimicrobial agent, a fragrance and a dye component;

wherein the composition has a pH of no more than 1.

19. The composition of claim 18, wherein $X^-$ represents a methanesulfonate anion;

the R group is a lauric, myristic and/or palmitic group; and the polysaccharide thickener consists of guar gum.

20. The composition of claim 18, wherein the weight ratio of the glycine betaine ester to the alcohol ROH is about 10:1 to 1:2.

21. The composition of claim 18, wherein the composition has a viscosity of about 500 to 1,500 cP at a shear rate of 10 at 25° C., a viscosity of about 150 to 1000 cP at a shear rate of 50 at 25° C. and a 10/50 shear rate ratio of no more than about 2.5.

22. The composition of claim 18, wherein the one or more optional other polysaccharide thickeners is one or more natural gums selected from agar, carob gum, gellan gum, xanthan gum, and acacia gum.

* * * * *